US011292684B2

(12) United States Patent
Baldaccini

(10) Patent No.: US 11,292,684 B2
(45) Date of Patent: Apr. 5, 2022

(54) UNWINDER FOR ROLLS OF PAPER WEB MATERIAL

(71) Applicant: TECNO PAPER SRL, Capannori (IT)

(72) Inventor: Paolo Baldaccini, Capannori (IT)

(73) Assignee: TECNO PAPER SRL, Capannori (IT)

( * ) Notice: Subject to any disclaimer, the term of this patent is extended or adjusted under 35 U.S.C. 154(b) by 296 days.

(21) Appl. No.: 16/629,759

(22) PCT Filed: Jul. 10, 2018

(86) PCT No.: PCT/IT2018/050128

§ 371 (c)(1),
(2) Date: Jan. 9, 2020

(87) PCT Pub. No.: WO2019/012567

PCT Pub. Date: Jan. 17, 2019

(65) Prior Publication Data

US 2021/0147168 A1 May 20, 2021

(30) Foreign Application Priority Data

Jul. 13, 2017 (IT) ..... 102017000078461

(51) Int. Cl.
*B65H 16/10* (2006.01)
*B65H 23/00* (2006.01)

(52) U.S. Cl.
CPC ..... *B65H 16/103* (2013.01); *B65H 16/106* (2013.01); *B65H 23/005* (2013.01);
(Continued)

(58) Field of Classification Search
None
See application file for complete search history.

(56) References Cited

U.S. PATENT DOCUMENTS 3,232,549 A * 2/1966 Stambaugh ..... B65H 18/20 242/534.2
3,306,547 A * 2/1967 Reid ..... B21C 47/003 242/541.7

(Continued)

FOREIGN PATENT DOCUMENTS

WO WO2006/012815 * 2/2006

OTHER PUBLICATIONS

International Search Report, dated Sep. 11, 2018, from corresponding PCT application No. PCT/IT2018/050128.

(Continued)

*Primary Examiner* — William A. Rivera
(74) *Attorney, Agent, or Firm* — Nixon & Vanderhye

(57) ABSTRACT

An unwinder for rolls of paper web material includes: a support frame; a spindle cylinder, rotationally associated with the frame, supporting a parent roll with a longitudinal axis; unwinder to unwind a paper web from the parent roll; actuator keeping the unwindier contacting the parent roll; a command and control unit; first motor rotating the spindle cylinder; two support and drive rollers; units to measure instantaneous radius of the parent roll, rotational speed of the spindle cylinder, quantity of web unrolled from the parent roll per unit time, and weight unloaded from the parent roll onto the support and drive rollers; second motor synchronously rotating the support and drive rollers; and third motor moving the spindle cylinder vertically. The control unit receives and processes values detected by the measurement unit, causing the motor to maintain the weight force unloaded onto the rollers from the roll as the diameter varies.

11 Claims, 5 Drawing Sheets

(52) U.S. Cl.
CPC ..... *B65H 2301/413246* (2013.01); *B65H 2301/413526* (2013.01); *B65H 2403/55* (2013.01); *B65H 2404/421* (2013.01); *B65H 2515/10* (2013.01)

(56) References Cited

U.S. PATENT DOCUMENTS 3,394,897 A 7/1968 Martin, Sr.
4,632,325 A 12/1986 Feyerl et al.
4,811,915 A * 3/1989 Smith ..... B65H 18/20 242/534.2
4,817,883 A * 4/1989 Hoffmann ..... B65H 18/20 242/534
4,869,436 A 9/1989 Mobley
4,944,470 A * 7/1990 Mobley ..... B65H 19/126 156/502
5,314,128 A * 5/1994 Alexander, III ..... B65H 18/20 139/311
5,377,296 A * 12/1994 Greenway ..... B66B 1/30 226/25
5,593,106 A * 1/1997 Cavanagh ..... B65H 18/20 242/527
5,632,456 A * 5/1997 Kruger ..... B65H 18/14 242/541.5
5,855,337 A * 1/1999 Schonmeier ..... B65H 18/26 242/541.7
6,705,562 B1 * 3/2004 Cramer ..... B65H 18/20 242/541.7
2002/0185567 A1 * 12/2002 Stitz ..... B65H 18/16 242/534

OTHER PUBLICATIONS

Written Opinion, dated Sep. 11, 2018, from corresponding PCT application No. PCT/IT2018/050128.

* cited by examiner

UNWINDER FOR ROLLS OF PAPER WEB MATERIAL

FIELD OF APPLICATION

The invention relates to the field of industrial machinery for converting paper and/or processing web materials.

More in detail, the invention relates to an unwinder for rolls of paper web material, in particular, but not exclusively, tissue paper, of conventional or structured type, TNT (non-woven) fabric, TAD (Through Air Drying), or other similar materials characterized by a high lightness and a low density.

BACKGROUND ART

An unwinder is a machine that allows the unwinding of large diameter parent rolls along a processing line.

Parent rolls are designed with a single paper ply: multiple unwinders in series unwind the single paper plies and allow the coupling thereof (two, three or four paper plies) according to the specific needs of the product to be made, to form then rollers of smaller diameter, but with thicker paper.

Traditional unwinders comprise a fixed support frame; a cylinder, on which the parent rolls are formed, rotatably associated in an idle manner with said support frame; a controlled-speed unwinding member and an actuator which presses said unwinding member against the parent roll.

Normally, such unwinders have, as an unwinding member, a flexible member, for example one or more belts, returned around a plurality of pulleys, at least one of which is motorized.

From patent application for utility model no. FI1995U000044, a belt type unwinder is known.

The belt is in contact with the outer surface of the roll by a sufficiently extended arc and with a sufficiently high pressure to ensure a frictional force such as to allow the drive in rotation of the roll.

Known unwinders comprise systems for adjusting the position of the unwinding member with respect to the outer surface of the roll, so that there is always a proper contact between the parts, as the diameter of the roll varies due to the progressive unwinding of the material web.

The pressure exerted by the flexible member must be carefully calibrated, so as to prevent it from exceeding the resistance limits of the roll when it decreases in diameter, especially when the thrust of the unwinding member is added to the weight of the roll, i.e. when the unwinding member presses on the roll from above. A pressure that is too low implies, on the contrary, difficulty in controlling the unwinding in the initial phase.

Such solutions therefore exhibit important difficulties due to the pressing action of the unwinding belts, in combination with the fragility of the material wound on the roll.

Disadvantageously, if such a pressing action is too strong, the belts deform the roll and damage the material.

Furthermore, the unwinding command imparted by the belts on the outer surface of the roll is transferred with difficulty and delay to the cylinder on which the roll is formed, and there is the risk that such inertia may deform the material and the roll, before it is actually put in rotation with respect to the support frame.

Even more disadvantageously, large rolls tend to become ovalized during the unwinding step, due to their own weight, having no lower support.

From the patent application for industrial invention FI2014A000218, an unwinder is known in which the unwinding belt forms a lower support saddle for the roll itself: in this way, the ovalization of the roll is prevented, as in part it is supported by the support on the belt, but the problems of damage to the paper due to the pressure and the strong friction caused by the belt itself are not solved.

DISCLOSURE OF THE INVENTION

It is therefore the object of the present invention to overcome the above drawbacks by providing an unwinder for rolls of paper web material that is simple and effective in adapting to the variation in the diameter of the parent roll being unwound, which preserves the roll itself from any damage and reduces the ovalization thereof.

The object of the invention is achieved with an unwinder for rolls of paper web material comprising:

- a support frame;
- a spindle cylinder, rotationally associated with said support frame, capable of supporting a parent roll having a longitudinal axis;
- unwinding means acting by contact with said parent roll to unwind from it a web of paper material;
- actuator means capable of keeping said unwinding means in contact with said parent roll;
- a command and control unit, characterized in that it comprises:

- first motor means capable of applying a rotation movement to said spindle cylinder;
- two support and drive rollers for said roll, provided with respective longitudinal axes, arranged symmetrically with respect to a vertical plane passing through said longitudinal axis of the parent roll;
- measurement means to measure the instantaneous radius of said parent roll;
- measurement means to measure the rotation speed of said spindle cylinder;
- measurement means to measure the quantity of web unrolled from said parent roll by unit of time;
- measurement means to measure the weight unloaded from said parent roll onto said two support and drive rollers;
- second motor means, associated with said two support and drive rollers, capable of giving them a synchronous rotation movement around their respective longitudinal axis;
- third motor means associated with said actuator means and capable of moving said spindle cylinder vertically, wherein said command and control unit is capable of receiving and processing the values detected by said measurement means to command said first, second and third motor means, so as to maintain constant the weight force unloaded onto said support and drive rollers from said roll as the diameter of the latter varies.

According to a first aspect of the invention, characterized in that said measurement means to measure the instantaneous radius of said parent roll comprise means to measure the distance between said longitudinal axis of the parent roll and said longitudinal axes of said two support and drive rollers.

In particular, said means to measure the distance between said longitudinal axis of the parent roll and said longitudinal axes of said two support and drive rollers comprise magnetostrictive sensors.

Alternatively, said means to measure the instantaneous radius of said parent roll comprise an electromagnetic wave instrument.

According to a further aspect of the invention, said means to measure the quantity of web unrolled from said parent roll by unit of time comprise means to measure the rotation speed of the support and drive rollers, associated with said second motor means.

According to further aspects of the invention, said means to measure the rotation speed of said spindle cylinder and of said support and drive rollers comprise an encoder, said means to measure the weight unloaded from said parent roll onto said two support and drive rollers comprise a load cell.

Alternatively, said load cell is associated with said spindle cylinder, or with said support and drive rollers.

According to further aspects of the invention, said support frame comprises two columns and said actuator means comprise a first rack and a second rack, stably associated with said two columns, on which the two ends of said spindle cylinder slide.

In a preferred variant, said unwinder comprises fourth motor means, capable of adjusting the position of the pair of support and driver rollers along the direction of the respective longitudinal axes.

The invention has numerous advantages substantially due to the possibility of vertically rotating and translating said spindle cylinder, controlling the rotation speed thereof, that of the support and drive rollers, the weight of the roll discharged thereon, the amount of web instantaneously unrolled and the value of the instantaneous radius of the roll.

The first motor means impose a direct rotation to the spindle cylinder on which the roll is formed: the rotary motion is not imposed on the roll starting from its outer surface, as was the case in the prior art of the peripheral belts, but is obtained by acting directly on the central axis thereof. This, in addition to eliminating the problems due to rotation inertias, prevents the paper from being damaged.

Said command and control unit is capable of receiving and processing the values detected by said measurement means to command said first, second, third and fourth motor means.

Verification by the command and control unit of the measured data ensures the correct functioning of the unwinder, which cannot rely only on the initial theoretical preset data concerning the parent roll, but must take into account all the variations of the parameters involved as the unwinding is carried out, and therefore as the roll radius is reduced, that its weight unloaded on the support and drive rollers tends to decrease, and that the rotation speed of the spindle cylinder increases.

The rotation speed of the spindle cylinder is in fact a function of the quantity of unrolled web and of the instantaneous roll radius, as well as the pressure unloaded from the roll on the support and drive rollers, which must be kept constant at a minimum value necessary to ensure stability to the unwinding and prevent ripples of the web, in jargon called NIP.

For this purpose, the means for measuring the weight unloaded from said parent roll on said support and drive rollers, and therefore the use of said load cell, are advantageous.

The support and drive rollers, placed underneath the parent roll, support it and prevent the ovalization thereof during the unwinding.

The support and drive rollers arranged symmetrically with respect to the vertical plane passing through the longitudinal axis of the roll ensure a stable support for the same and ensure constant contact and uniform distribution of the weight of the roll itself.

The second motor means, associated to both the support and drive rollers, allow the unwinding of the roll in both directions, clockwise or anticlockwise, depending on the configuration of the unwinder and the distribution of the paper processing line.

The third motor means, associated with the actuator means and adapted to move the spindle cylinder vertically, and the means for measuring the distance between the longitudinal axis of the roll and the longitudinal axes of said two support and drive rollers, allow the unwinder to adapt to rolls of different sizes, in addition to allowing the instantaneous variation of the unwinder configuration during the unwinding of the web, as the parent roll gradually changes its diameter.

BRIEF DESCRIPTION OF THE DRAWINGS

Further features and advantages of the invention will become apparent from the more detailed description set forth below, with the aid of the drawings which show a preferred embodiment thereof, illustrated by way of non-limiting example, in which.

DETAILED DESCRIPTION OF A PREFERRED EMBODIMENT OF THE INVENTION

Figure 1:
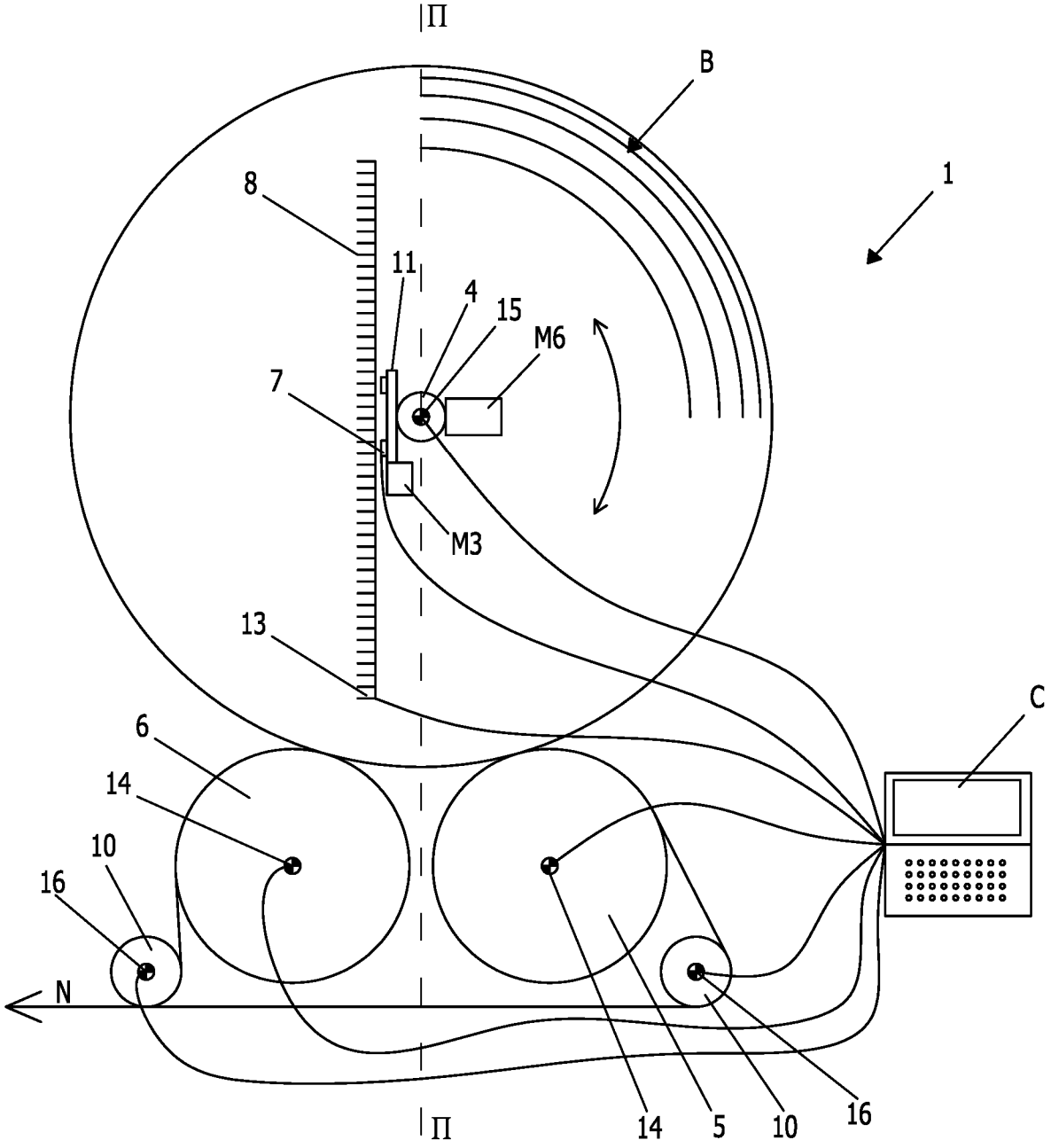
FIG. 1 shows a simplified schematic view of the main components of an unwinder for rolls of paper web material according to the invention.
Figure 2:
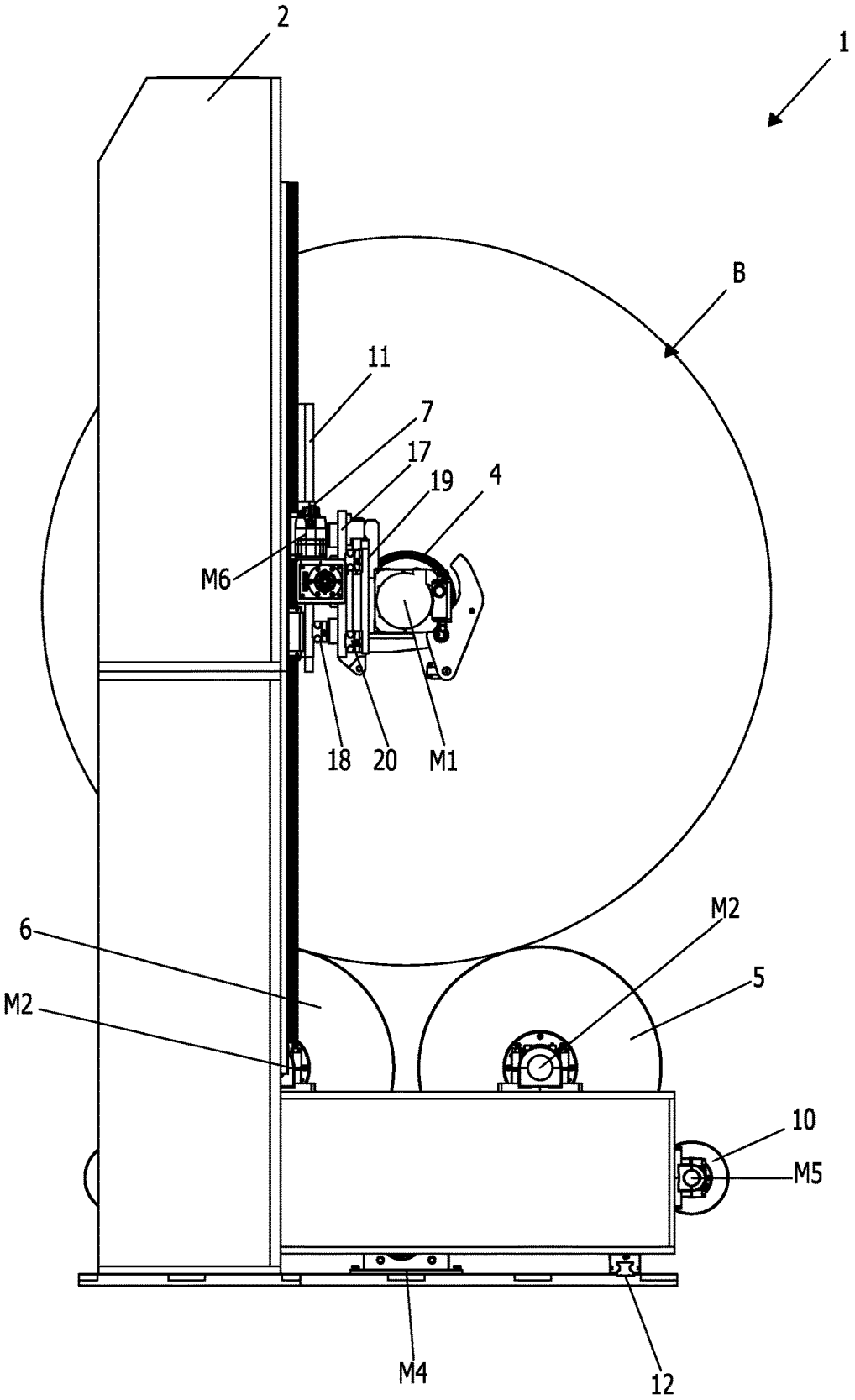
FIGS. 2, 3 and 4 show a side view, a front view and a perspective view, respectively, of an unwinder for rolls of paper web material according to the invention.
Figure 3:
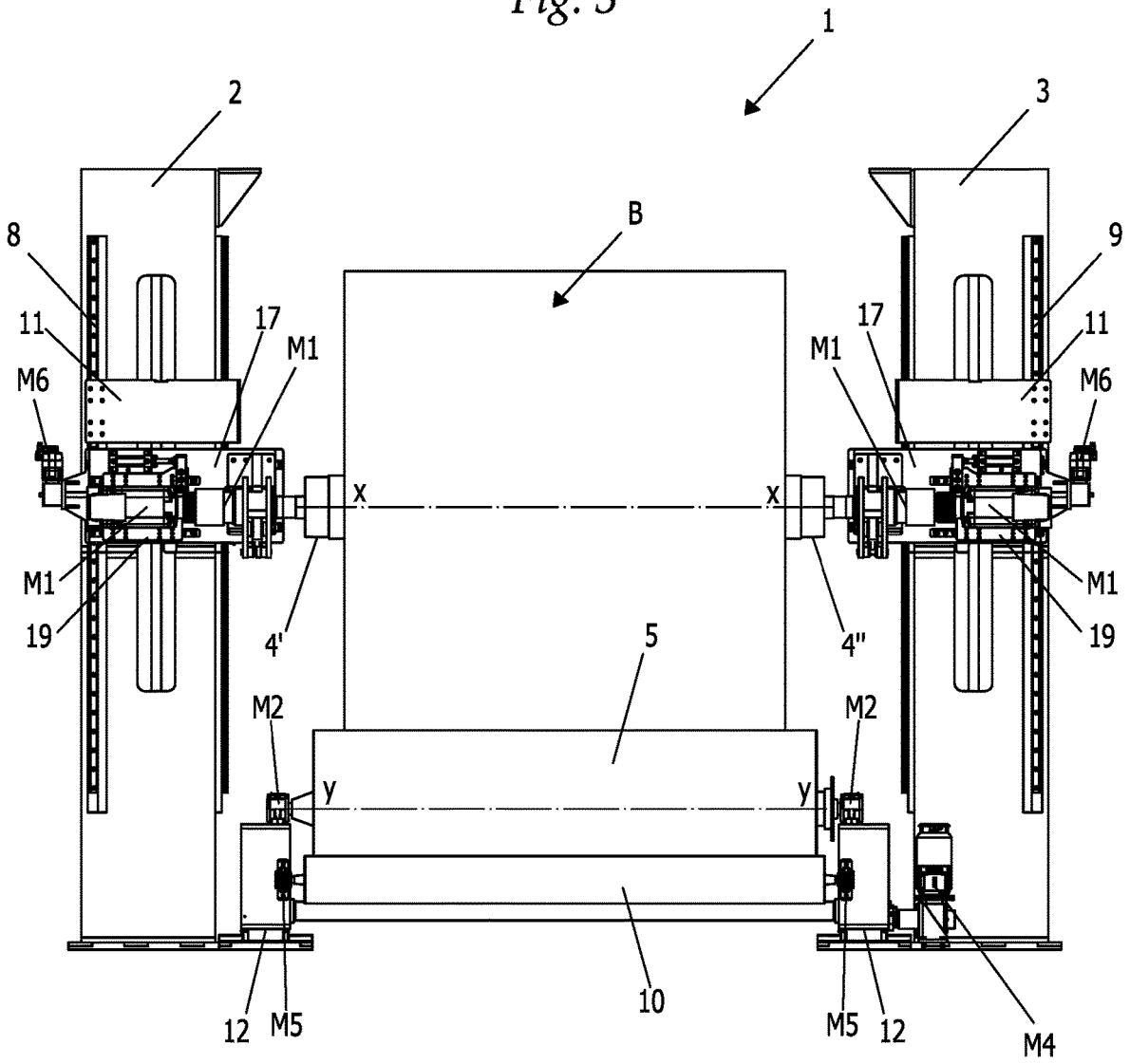
Figure 4:
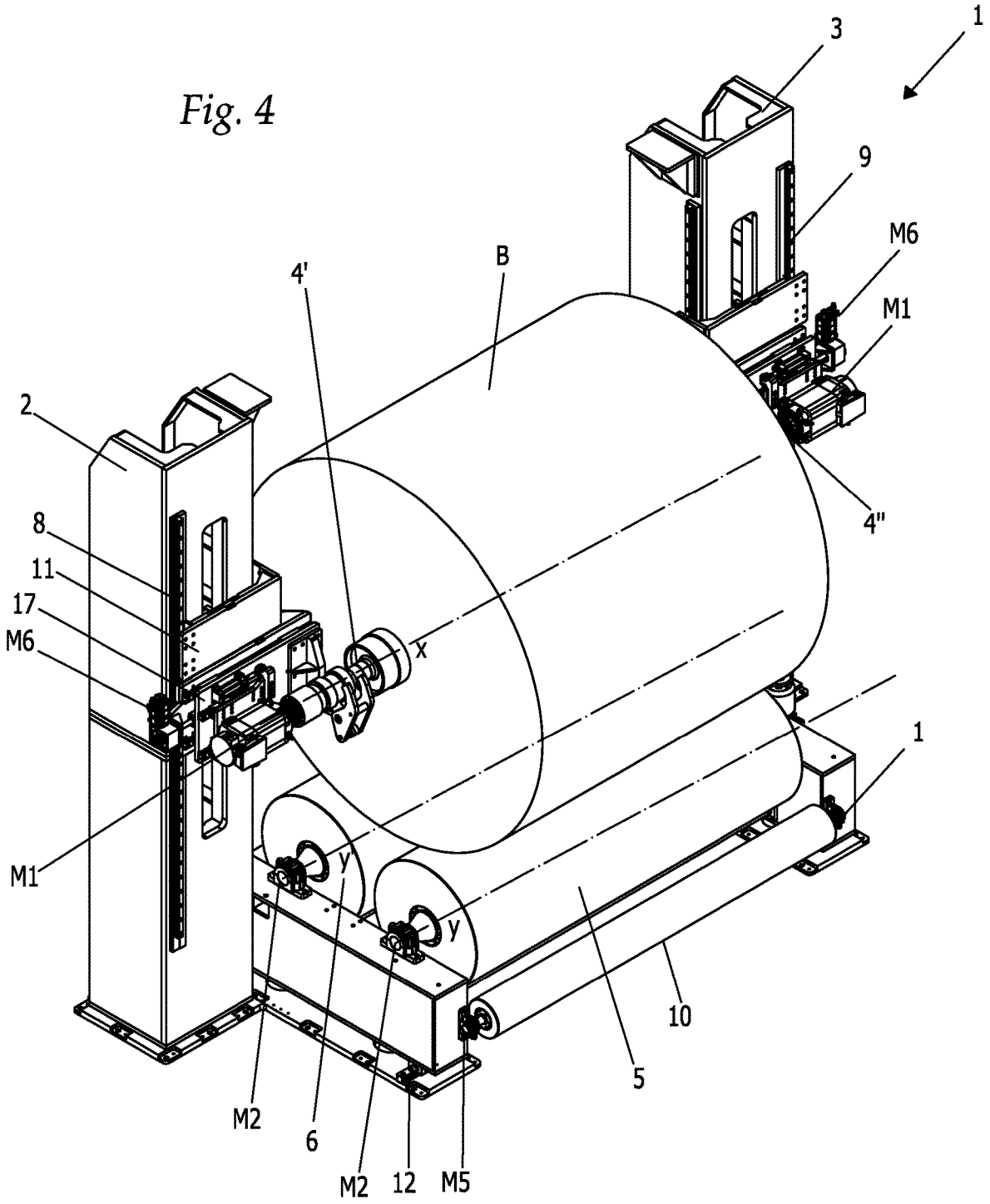
Figure 5:
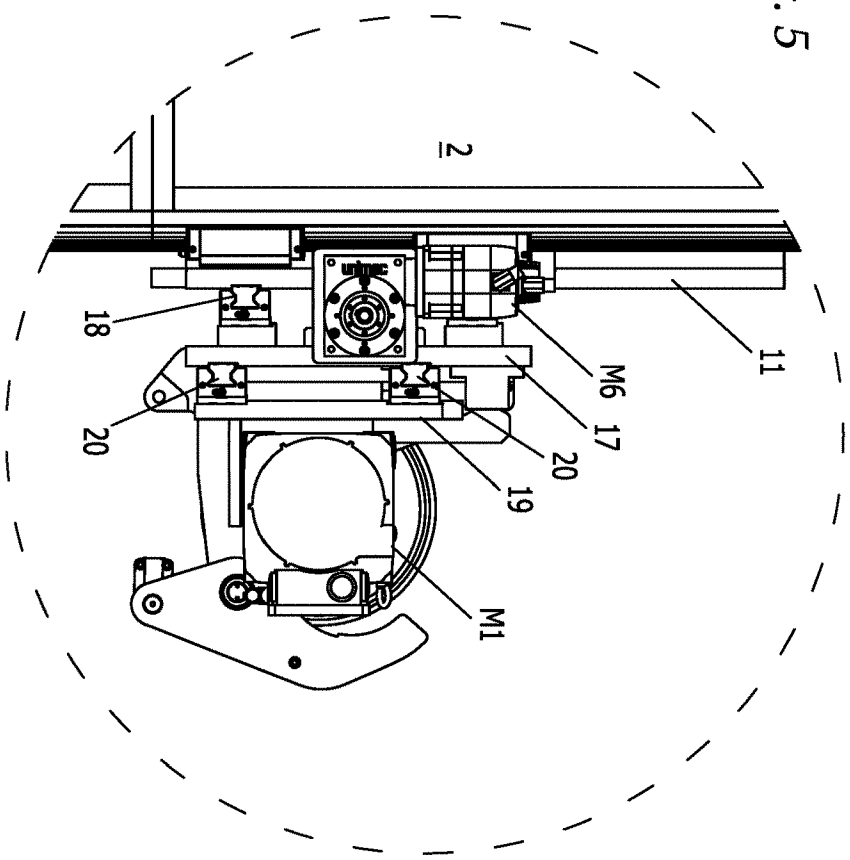
FIGS. 5 and 6 show a side view and front view, respectively, of a detail of the unwinder according to the invention taken as an enlargement from FIGS. 2 and 3.
Figure 6:
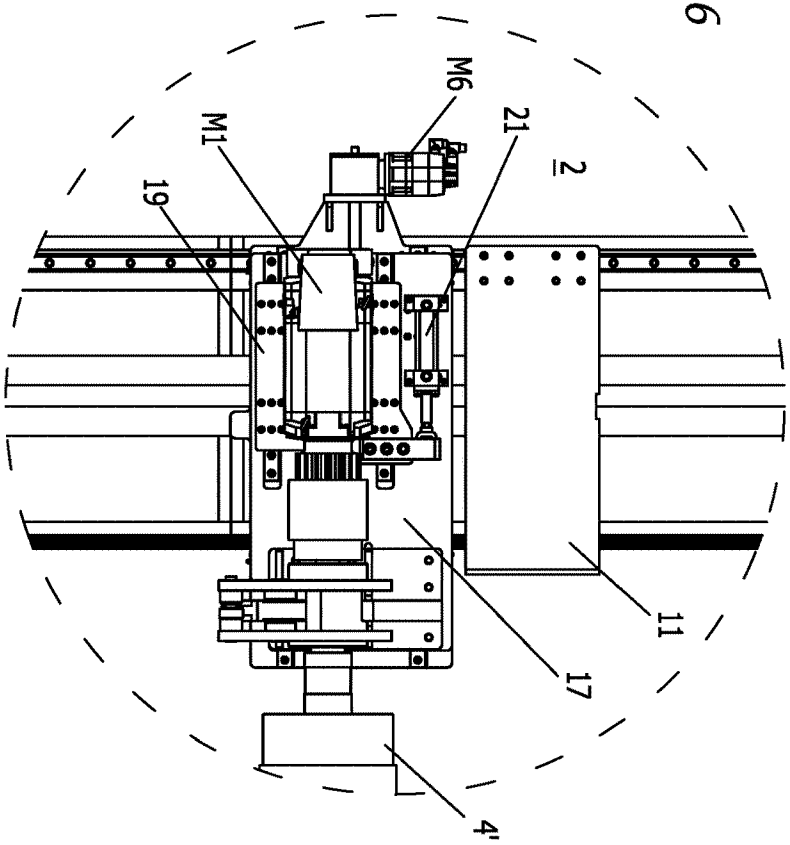

With reference to the details in the figures, an unwinder 1 for rolls B of paper web material having a longitudinal axis x is shown.

Said paper web material may be, by way of non-limiting example:

- conventional tissue paper, normally used for the production of toilet paper or napkins;
- structured tissue paper, i.e. large-thickness single-ply paper, with a structured and inflated texture (very sensitive to crushing and elongation problems and therefore particularly adapted to be managed by unwinders according to the invention);
- TNT (non-woven fabric) or TAD (through air dryer paper).

Unwinders 1 work on parent rolls B of large dimensions, up to three meters in diameter. At the beginning of the processing step, the standard parameters of these parent rolls B are known: total weight, diameter, density, length of the web, weight of the web per unit of surface, which are previously set in software contained in a command and control unit of the unwinder.

Said unwinder 1 essentially comprises:

- a support frame substantially comprising two columns 2, 3 resting on the ground;
- a spindle cylinder 4, rotationally and slidably associated with said support frame, capable of supporting a parent roll B having a longitudinal axis x;
- unwinding means acting by contact with said parent roll B to unwind from it a web N of paper material;
- actuator means capable of keeping said unwinding means in contact with said parent roll B;
- two support and drive rollers 5, 6 for said roll B, called helpers in jargon, provided with respective longitudinal axes y, y', arranged symmetrically with respect to a vertical plane π passing through said longitudinal axis x;

two return rollers 10, located downstream of the support and drive rollers 5, 6, adapted to keep the web N aligned and tensioned while unwinding.

By the term spindle cylinder it is meant alternatively a rod, or a core, or a pair of punches adapted to axially support said parent roll.

Said spindle cylinder 4, advantageously made of steel, is provided with a first 4' and a second 4" end.

Each end 4', 4" is rotatably and slidably associated with one of said two columns 2, 3, by means of bearings and a plurality of slides, support plates and counterplates and sliding and centering shoes.

Said actuator means are of the linear type and act on said spindle cylinder 4.

In particular, said actuator means comprise two racks 8, 9, each stably associated with a column 2, 3 resting on the ground of said support frame.

On said racks 8, 9 slides 11 are slidable, each provided with a pinion. Said slides 11 are therefore adapted to move vertically along said racks 8, 9.

Plate 17 for supporting the ends 4', 4" of said spindle cylinder 4 are associated with said slides 11, and said plates 17 are adapted to move horizontally with respect to said slides 11.

Centering shoes 18 are in fact provided between said slides 11 and said plates 17, adapted to allow translation of said spindle cylinder with respect to said columns 2, 3, so that the center line of the parent roll B is aligned with the machine axis of the unwinder 1, i.e. the center line between the two columns 2, 3 resting on the ground of said support frame.

Said support and drive rollers 5, 6 are arranged below said parent roll B, they are preferably made of carbon fiber and therefore very light. In order to ensure a good grip on the web N being unrolled, and therefore always maintain control over unwinding, said support and drive rollers 5, 6 are coated with suitable materials, for example tungsten carbon.

Both said support and drive rollers 5, 6 are motorized, rotate in the same direction, right or left, according to the direction of unwinding of the web N from the parent roll B.

Basically, said support and drive rollers 5, 6 have both a support function along two generatrix lines of roll B to prevent the ovalization thereof, especially for very soft and low density papers, as well as an accompanying and thrusting function for the unwinding of web N.

Said support and drive rollers 5, 6 comprise centering shoes 12 for the horizontal displacement along the longitudinal axis y, y' thereof.

Said support and drive rollers 5, 6 by translating horizontally also move the overlying parent roll B, so as to make the machine axis of the unwinder 1 coincide with the center line of the roll B itself.

The horizontal displacement of said support and drive rollers 5, 6 is coordinated and serves the sliding of said plates 17 which support the ends 4', 4" of the spindle cylinder 4.

Said unwinder 1 further comprises:

measurement means to measure the instantaneous radius of said parent roll B;

measurement means to measure the rotation speed of said spindle cylinder 4;

measurement means to measure the quantity of web N unrolled from said parent roll B by unit of time;

measurement means to measure the weight unloaded from said parent roll B onto said support and drive rollers 5, 6.

Said unwinder 1 further comprises:

first motor means M1, adapted to impose a rotation movement to said spindle cylinder 4, slidably associated with said plates 17, so as to be able to move along the axis of said spindle cylinder;

second motor means M2, adapted to impart a rotation movement to said support and drive rollers 5, 6, about the respective longitudinal axis y, y';

third motor means M3, associated with said actuator means and capable of moving said spindle cylinder 4 vertically;

fourth motor means M4, adapted to adjust the position of said support and drive rollers 5, 6 along their longitudinal axis y, y', acting on said centering shoes 12;

fifth drive means M5, adapted to impart a rotation movement to said return rollers 10;

sixth motor means M6, adapted to adjust the position of said plates 17 along the longitudinal axis x of said parent roll B;

a command and control unit C which oversees all the kinematic adjustments of said unwinder 1, both instantaneous and over time, in which there is software adapted to impose the appropriate acceleration and deceleration ramps to the unwinder and to oversee all the functions of the unwinder itself.

As said above, said first motor means M1 are slidably associated with said plates 17, so as to be able to be moved horizontally in order to always be gripped on the ends 4', 4" of said spindle cylinder 4.

In particular, said first motor means M1 are fixed to counterplates 19 sliding by means of shoes 20 on said plates 17 by action of a hydraulic cylinder 21.

Said measurement means to measure the instantaneous radius of said parent roll B substantially comprise means to measure the distance between said longitudinal axis x of said roll B and said longitudinal axes y, y' of said support and drive rollers 5, 6.

In the variant illustrated, said means for measuring the distance between said longitudinal axis x and said longitudinal axes y, y' comprise magnetostrictive sensors 13, particularly advantageous for their high precision, repeatability and durability due to resistance to vibrations and mechanical shocks.

Said magnetostrictive sensors 13 are associated with the columns 2, 3 resting on the ground of said frame structure.

The measurement of the distance between said longitudinal axis x and said longitudinal axes y, y' basically allows the control unit C to know the real dimension of the parent roll B as the web N is unwound.

In an alternative embodiment not shown, said means for measuring the instantaneous radius of said coil B comprise an optical reader, for example ultrasound, associated with said support frame structure and facing towards the roll B. The generated electromagnetic waves are intercepted by the roll and depending on the return speed, it is possible to estimate the size of the roll itself.

Said means to measure the quantity of web N unrolled from said parent roll B by unit of time comprise means to measure the rotation speed of the support and drive rollers 5, 6 associated with said second motor means M2 (also related to the rotation speed of the return rollers 10 associated to said fifth motor means M5).

The measurement of the amount of web N unrolled from said parent roll B per unit of time can be substantially related to the rotation speed of the support and drive rollers 5, 6 (and of the return rollers 10) and allows the control unit C to set the speed at which said spindle cylinder 4, and therefore said parent roll B, should rotate.

If, in fact, the rotation speed of the spindle cylinder 4 is too low with respect to the rotation speed of the support and drive rollers 5, 6, there would be a risk of tearing the web N on the outermost winding of the parent roll B.

If, on the other hand, the rotation speed of the spindle cylinder 4 is too high with respect to the speed of the support and drive rollers 5, 6, an excess of unwound web N and not correctly arranged along the processing line would be produced, with the risk of jamming of the unwinder 1 and wrinkling and damaging the web itself.

Said means for measuring the rotation speed of the support and drive rollers 5, 6, of said spindle cylinder 4, and of the return rollers 10, each comprise an encoder 14, 15, 16.

Said means to measure the weight unloaded from said parent roll B onto said two support and drive rollers 5, 6 comprise a load cell 7.

In the variant shown, said load cell 7 is associated with said spindle cylinder 4. In particular, said load cell 7 is connected between two portions of said slide 11.

The measurement of the weight unloaded from said parent roll B on said support and drive rollers 5, 6 is substantially indicative of the pressure exerted by the roll B on the support and drive rollers 5, 6, or of the "NIP".

In order to ensure the correct work of the unwinder 1, said pressure must be kept substantially constant, also to ensure a uniform final quality of the web N.

In order to ensure a constant NIP, in spite of the roll B being reduced in diameter during the unwinding, it is necessary to act on the distance of the roll B from the support and drive rollers 5, 6: while the roll B unwinds it is clear that the NIP would tend to decrease and it is therefore necessary to lower said roll B to increase the unloading thereof on the support and drive rollers 5, 6. At the same time, it is important not to increase too much the NIP in order not to risk the deformation and the stretching of the material during the unwinding, if not even the tearing thereof.

An indicative value of NIP for tissue unwinders is approximately 0.2 kg/cm.

In an alternative variant, said load cell is associated with said support and drive rollers. In this case, the weight loaded on the support and drive rollers is measured (always and in any case related to the weight unloaded from the roll).

Said third motor means M3 also comprise an encoder adapted to measure the rotation of the pinions adapted to read the racks 8, 9 of the actuator means: in this way, the linear displacement carried out by the spindle cylinder 4 along the racks 8, 9 and the speed of this displacement are also indirectly measured. Knowing the latter speed of movement allows the control unit C to also coordinate all the rotation speeds of the various components, be they the spindle cylinder 4 or the support and drive rollers 5, 6, also due to the fact that all the motor means M1, M2, M3, M4, M5, M6 used on the unwinder are under inverter.

The invention claimed is:

1. Unwinder (1) for rolls (B) of paper web material comprising:

a support frame;

a spindle cylinder (4), rotationally associated with said support frame, capable of supporting a parent roll (B) having a longitudinal axis (x);

unwinding means acting by contact with said parent roll (B) to unwind from the parent roll a web (N) of paper material;

actuator means capable of keeping said unwinding means in contact with said parent roll (B);

a command and control unit (C), comprising first motor means (M1) capable of applying a rotation movement to said spindle cylinder (4);

two support and drive rollers (5, 6) for said roll (B), provided with respective longitudinal axes (y, y'), arranged symmetrically with respect to a vertical plane (n) passing through said longitudinal axis (x) of the parent roll (B);

measurement means to measure the instantaneous radius of said parent roll (B);

measurement means to measure the rotation speed of said spindle cylinder (4);

measurement means to measure the quantity of web (N) unrolled from said parent roll (B) by unit of time;

measurement means to measure the weight unloaded from said parent roll (B) onto said two support and drive rollers (5, 6);

second motor means (M2), associated with said two support and drive rollers (5, 6), capable of giving them a synchronous rotation movement around their respective axis (y, y');

third motor means (M3) associated with said actuator means and capable of moving said spindle cylinder (4) vertically, wherein said command and control unit (C) is capable of receiving and processing the values detected by said measurement means to command said first (M1), second (M2) and third (M3) motor means, so as to maintain constant the weight force unloaded onto said support and drive rollers (5, 6) from said roll (B) as the diameter of the latter varies.

2. Unwinder (1) according to claim 1, wherein said measurement means to measure the instantaneous radius of said parent roll (B) comprise means to measure the distance between said longitudinal axis (x) of the parent roll (B) and said longitudinal axes (y, y') of said two support and drive rollers (5, 6).

3. Unwinder (1) according to claim 2, wherein said means to measure the distance between said longitudinal axis (x) of the parent roll (B) and said longitudinal axes (y, y') of said two support and drive rollers (5, 6) comprise magnetostrictive sensors.

4. Unwinder (1) according to claim 1, wherein said means to measure the instantaneous radius of said parent roll (B) comprise an electromagnetic wave instrument.

5. Unwinder (1) according to claim 1, wherein said means to measure the quantity of web (N) unrolled from said parent roll (B) by unit of time comprise means to measure the rotation speed of the support and drive rollers (5, 6), associated with said second motor means (M2).

6. Unwinder (1) according to claim 5, wherein said means to measure the rotation speed of said spindle cylinder (4) and said support and drive rollers (5, 6) comprise an encoder (14, 15).

7. Unwinder (1) according to claim 1, wherein said means to measure the weight unloaded from said parent roll (B) onto said two support and drive rollers (5, 6) comprise a load cell (7).

8. Unwinder (1) according to claim 7, wherein said load cell (7) is associated with said spindle cylinder (4).

9. Unwinder (1) according to claim 7, wherein said load cell (7) is associated with said support and drive rollers (5, 6).

10. Unwinder (1) according to claim 1, wherein said support frame comprises two columns (2, 3) and said actuator means comprise a first rack (8) and a second rack (9), stably associated with said two columns (2, 3), on which the two ends (4', 4") of said spindle cylinder (4) slide.

11. Unwinder (1) according to claim 1, further comprising fourth motor means (M4), capable of adjusting the position of the pair of support and driver rollers (5, 6) along the direction of the respective longitudinal axes (y, y').

* * * * *